US011078055B2

(12) United States Patent
Walker et al.

(10) Patent No.: US 11,078,055 B2
(45) Date of Patent: Aug. 3, 2021

(54) HOIST MECHANISM AND A STEPLESS ADJUSTMENT SYSTEM

(71) Applicant: AUTOCHAIR LIMITED, Alfreton (GB)

(72) Inventors: Matthew James Walker, Matlock (GB); Christopher John Sloss, Sheffield (GB)

(73) Assignee: AUTOCHAIR LIMITED, Alfreton (GB)

( * ) Notice: Subject to any disclaimer, the term of this patent is extended or adjusted under 35 U.S.C. 154(b) by 0 days.

(21) Appl. No.: 16/462,137

(22) PCT Filed: Nov. 17, 2017

(86) PCT No.: PCT/GB2017/053472
§ 371 (c)(1),
(2) Date: May 17, 2019

(87) PCT Pub. No.: WO2018/091918
PCT Pub. Date: May 24, 2018

(65) Prior Publication Data

US 2019/0330031 A1 Oct. 31, 2019

(30) Foreign Application Priority Data

Nov. 17, 2016 (GB) ..... 1619491

(51) Int. Cl.
*B66C 23/44* (2006.01)
*B66C 1/20* (2006.01)
*B66C 23/16* (2006.01)

(52) U.S. Cl.
CPC ..... *B66C 23/44* (2013.01); *B66C 1/20* (2013.01); *B66C 23/166* (2013.01)

(58) Field of Classification Search
CPC .. B66C 1/12; B66C 1/20; B66C 23/44; B66C 23/166; B66C 23/54; A61G 7/1017;
(Continued)

(56) References Cited

U.S. PATENT DOCUMENTS 573,703 A 12/1896 Robbins
2,375,104 A * 5/1945 Heitshu ..... B66C 23/44 212/181
(Continued)

FOREIGN PATENT DOCUMENTS

DE 3917240 A1 11/1990
EP 0727384 A1 8/1996
(Continued)

OTHER PUBLICATIONS

European Patent Office, European Search Report, Application No. EP 12187485, dated Jan. 22, 2013, 2 pages.
(Continued)

*Primary Examiner* — Glenn F Myers
(74) *Attorney, Agent, or Firm* — Perkins IP Law Group LLC; Jefferson Perkins

(57) ABSTRACT

The invention relates to a hoist mechanism (20) intended primarily, but not exclusively, for moving a motor driven wheelchair or scooter into and/or out of the load carrying space of a vehicle. The hoist mechanism (20) comprises a lifting arm having, at least in part, a generally U-shaped cross section, and an actuator (28). A mounting point (56) for the actuator (28) is provided within the generally U-shaped cross section. The invention also relates to a stepless adjustment system suitable for use in such a hoist mechanism (20). The adjustment system comprises an inner section (34) received within an outer section (24) in a telescoping arrangement. The outer section (24) comprises first and second body portions (44A, 44B) provided with features for
(Continued)

engaging corresponding features (48A, 48B) provided on the inner section (34).

25 Claims, 6 Drawing Sheets

(58) Field of Classification Search
CPC ... A61G 2203/78; A61G 3/062; B60P 1/5428; B60P 1/48; B60P 1/483; B60P 1/486; B60P 1/50; B60P 1/5452; B60P 1/5476
See application file for complete search history.

(56) References Cited

U.S. PATENT DOCUMENTS

| | | | | |
|---|---|---|---|---|
| 3,756,637 | A * | 9/1973 | Wildi | H02B 1/052 439/819 |
| 4,365,924 | A | 12/1982 | Brigman et al. | |
| 4,596,336 | A | 6/1986 | Zwagerman | |
| 4,818,172 | A | 4/1989 | Johnson | |
| 5,459,891 | A | 10/1995 | Reeve et al. | |
| 5,645,180 | A | 7/1997 | Zaguroli, Jr. | |
| 2005/0217024 | A1 | 10/2005 | Aarestad | |
| 2007/0274817 | A1 | 11/2007 | Chepurny et al. | |
| 2008/0185229 | A1* | 8/2008 | Panzarella | B60N 2/163 187/200 |
| 2008/0317571 | A1* | 12/2008 | Cheatham, Jr. | A61G 3/062 414/541 |
| 2014/0144861 | A1 | 5/2014 | Davis | |

FOREIGN PATENT DOCUMENTS

| | | | |
|---|---|---|---|
| EP | 2335667 | A2 | 6/2011 |
| EP | 2578197 | A1 | 4/2013 |
| FR | 2795157 | A1 | 12/2000 |
| GB | 457660 | A | 11/1936 |
| WO | 0144671 | A1 | 6/2001 |
| WO | WO-2005/092776 | A1 | 10/2005 |

OTHER PUBLICATIONS

European Patent Office, European Examination Report, Application No. EP 12187485.3, dated Mar. 27, 2014, 5 pages.
The International Search Report and the Written Opinion of the International Searching Authority, International Application No. PCT/GB2017/053472, dated Apr. 9, 2018.

* cited by examiner

HOIST MECHANISM AND A STEPLESS ADJUSTMENT SYSTEM

The invention relates to a hoist mechanism intended primarily, but not exclusively, for moving a motor driven wheelchair or scooter into and/or out of the load carrying space of a vehicle, for example an estate type vehicle or people carrier. The invention also relates to a stepless adjustment system suitable for use in such a hoist mechanism.

Motor driven wheelchairs and scooters are typically much too heavy to be lifted manually, and frequently need to be loaded into, or unloaded from, a vehicle in which they are transported. Manually operated wheelchairs are lighter, but may nonetheless be difficult to lift into, or from, a motor vehicle. This is particularly the case where a passenger vehicle such as an estate car/station wagon, people carrier/minivan or Sports Utility Vehicle (SUV), may have a large lip or ledge on the entry to the load space.

To overcome this problem, hoist mechanisms are available for mounting in the load space of a passenger car. These hoists can be manually operated, but are often powered to further assist a user.

One example of a hoist design includes an upstanding pivot post, which is secured within and to one side of the load carrying space of a vehicle, and a lifting arm or boom pivotally connected at a lower end of said pivot post. A linear actuator, for example an electrical or hydraulic actuator is connected between said pivot post a point along the length of the lifting arm so that altering the length of the actuator raises and lowers the lifting arm. Adjustment means are provided for adjusting the length and reach of the lifting arm/boom, and a spreader bar is attached to the end of the arm/boom to space lifting straps or similar for attachment to a wheelchair, mobility scooter or similar.

The current design was developed to overcome some limitations in the previous designs. One overall aim was to provide a more versatile hoist mechanism, suitable for use in a wider variety of vehicles with varying packaging constraints, without compromising on the reach of the mechanism. As part of this, an improved stepless adjustment system was desirable to allow re-packaging of a hoist mechanism while retaining a range of adjustment, and problems with the stowage of a hoist mechanism, in particular the spreader bar, when the hoist was not in use had to be addressed.

According to the present invention there is provided a stepless adjustment system comprising an inner section received within an outer section in a telescoping arrangement, wherein the outer section comprises first and second body portions each provided with engagement features which interlock, in use, with corresponding engagement features provided on the inner section, and wherein a gap is provided between at least one of the engagement features of the first and second body portions and at least one of the engagement features provided on the inner section to allow rotation of the first and/or second body portions when the first and second body portions are forced together.

Fixing of clamping means, such as clamping blocks, may be provided to force the first and second body portions together, for example by tightening one or more bolts provided in/between the clamping blocks.

Each of the engagement formations may comprise a projection and/or recess for receiving a corresponding recess and/or projection of the first or second body portion. Each of the engagement formations may comprise a cross-sectional shape which mates with a corresponding cross-sectional shape of the first or second body portion. The engagement features on the first and second body portions may each receive corresponding engagement formations of the inner section.

The first and second body portions may each engage corresponding engagement formations of the first section at first and second engagement points. The first and second engagement points may be spaced apart from one another.

The first and second body portions may apply forces to the corresponding engagement formations at the first and second engagement points. The force applied at a first engagement point may be in a same direction as a force applied at a second engagement point, or may be in opposing or different directions.

Each of the engagement formations may protrude outwardly from the inner section. Each of the engagement formations may define at least one shoulder for engaging a corresponding portion of the first or second body portion. Each of the engagement formations may define first and second shoulders for engaging corresponding engagement formations of the first or second body portion. The first shoulder may be located proximal to a point of attachment of the first and second body portions, such as a clamping arrangement. The second shoulder may be located distal from said point of attachment of the first and second body portions. Each of the engagement formations may have a dovetail profile/cross-section.

The first and second body portions may define a hollow enclosure when the first and second body portions are attached to one another, for example such that the inner section is received within the hollow enclosure.

The hollow enclosure may comprise an open section on one side and a split line opposite the open section to allow the first and second body portions to be drawn together, for example by fixing or clamping means.

The first and second body portions may rotate into engagement with the corresponding engagement formations of the inner section as they are drawn together, such as during attachment or tightening of the first and second body portions by fixing or clamping means. The first and second body portions may rotate about a central longitudinal axis of the inner section during said attachment or tightening.

The stepless adjustment system may be incorporated into a hoist mechanism for loading into or unloading from a load carrying space of a vehicle. The hoist mechanism may be installable in said vehicle and may comprise a lifting arm pivotally connected to an actuator, the inclination of said lifting arm being controlled by the actuator. The lifting arm may be variable in upstanding height by a provision of a lower end section slidably connected to a main body of the lifting arm. The lower end section may be the inner section and the main body may be the outer section.

The lifting arm may be connected to the actuator at a mounting point located within an outer profile of the lifting arm. For example, where a mounting point or mounting bracket for the actuator may be provided within the outer section, and the actuator may extend through an opening or recess in the outer section to attach to the mounting point/bracket.

Also provided is a hoist mechanism for loading into or unloading from a load carrying space of a vehicle, the hoist mechanism being installable in said vehicle and comprising a lifting arm pivotable about a generally horizontal axis, and a spreader bar releasably attachable to the lifting arm, the spreader bar comprising a hook formation for engaging a corresponding engagement formation, for example a horizontal pin, of the lifting arm.

The hook formation may be shaped to prevent inadvertent removal of the spreader bar is from the lifting arm during use. The hook formation may be shaped such that the spreader bar is removable from the lifting arm in the absence of a load applied to the spreader bar.

A movable blocking component, such as a rocker plate, may be provided to help prevent incorrect attachment. The blocking component is provided on the lifting arm to obstruct access to the engagement formation, such that the blocking component must be moved to allow attachment of the hook.

The hook and engagement formation may be shaped to prevent incorrect engagement of the hook with the engagement formation of the lifting arm. In particular, the hook may only be attachable in one, preferred, orientation. For example, the maximum thickness of the hook on a first side may be greater than the maximum space or gap available between the movable blocking component and the engagement formation, while the maximum thickness of the hook on a second, opposite, side may be less than said space or gap. The first side of the hook may be an open side, and the second side a closed side.

Also provided is a hoist mechanism for loading into or unloading from a load carrying space of a vehicle, the hoist mechanism being installable in said vehicle and comprising a lifting arm pivotable about a generally horizontal axis and pivotally connected at an actuator mounting point to an actuator for controlling the inclination of said lifting arm, wherein the lifting arm has, at least in part, a generally U-shaped cross section, and wherein the actuator mounting point is provided within the generally U-shaped cross section.

The lifting arm may comprise stepless adjustment as described above, and the hoist may comprise a spreader bar and hook formation as previously described.

It is, therefore, important that such a hoist mechanism is completely reliable and easy to use. It is also advantageous if any necessary adjustments to such a hoist mechanism, when transferring it for use to another suitable vehicle, are able to be made relatively easily.

Any of the optional features described in relation to any single aspect of the invention may be applied to any other aspect of the invention.

An embodiment of the invention will now be described in greater detail, by way of illustration only, with reference to the accompanying drawings, in which FIG. 1 is a perspective view of a hoist mechanism according to the present invention;

Figure 1:
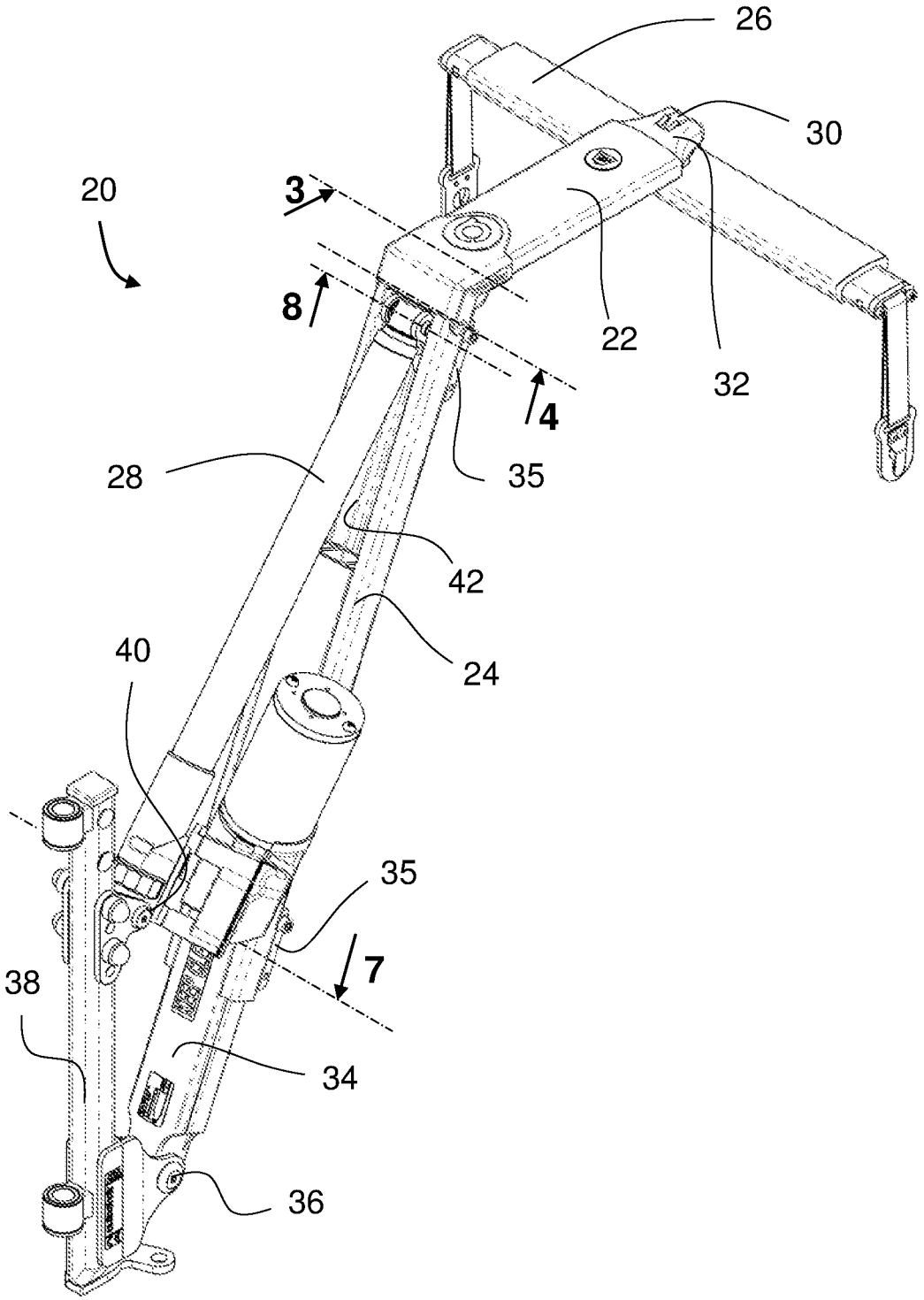

FIG. 1 shows an overview of an entire hoist mechanism 20 according to the present invention. The main components shown in FIG. 1 are the boom 22,24, comprising a first horizontal or top boom section 22 and a second boom section 24, hereafter referred to as a vertical boom section 24. As shown more clearly in the FIG. 2, the two boom sections 22,24 need not be at right angles.

The hoist mechanism also comprises a spreader bar 26 attached to the top section 22 via a hook 30 which is mounted on the spreader bar 26, and an actuator 28 attached to the vertical section 24.

Both the top section 22 and the vertical section 24 are provided as telescoping sections, with clamping blocks 35 provided on an outer body of the vertical section 24 allowing stepless adjustment of a top telescoping element 32 and a vertical telescoping element 34 within the body.

A lower end of the vertical telescoping element 34 is attached, at a pivot 36 to a pivot post 38 so that, in use, the boom can swing in a vertical arc about the pivot 36. The pivot post 38 is, in turn, secured to a mounting fixed in the load space of a passenger vehicle, and also provides a second pivot mounting 40 for the lower end of the actuator 28. As will be discussed in greater detail later, the upper end of the actuator 28 is fixed to the boom within a recess 42 provided in the vertical section 24.

One particular previous design, as described in EP2578197, provides a hoist designed to cope with loads of up to 200 kg. The hoist of EP2578197 was formed from large heavy-duty sections and the actuator bracket had to be securely mounted to cope with the strong actuator forces without slipping. This resulted in a hoist with a prominent mounting bracket that, when set up for lighter lifts of, for example, around 100 kg, effectively limited the actuator stroke to 200 mm.

This significantly reduced the lift range of the hoist, and particularly with vehicles such as Sports Utility Vehicles (SUVs), where a boot aperture is typically relatively small in height but the boot floor itself is high off the ground, the previous design was difficult to set up to achieve the lift.

The hoist mechanism 20 of the present invention is designed for smaller loads, of around 100 kg, has a much greater lift range for the small boom lengths, increasing the range of vehicles for which it is suitable. The hoist mechanism 20 also requires only 14 screws to be loosened and tightened to make the maximum number of adjustments during set up. In contrast, the hoist of EP2578197 requires 28 screws to be loosened and tightened. The build time and set-up time of the hoist mechanism 20 is therefore reduced.

Figure 2:
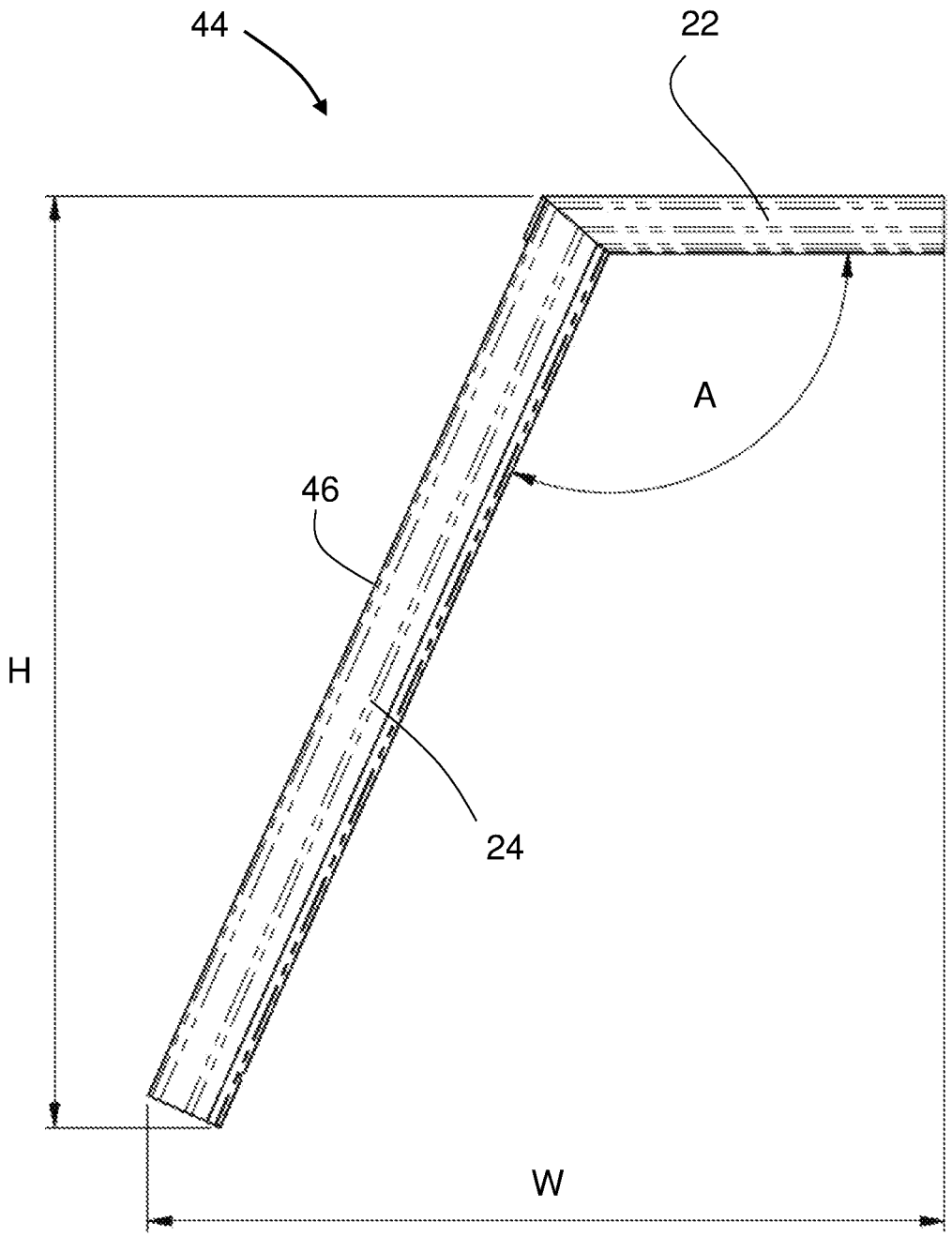
FIG. 2 is a perspective view showing part of the hoist arm or boom from FIG. 1.

FIG. 2 shows a side view of the outer body 44 of the boom with the telescoping elements 32,34 removed. The outer body 44 is formed from extruded sections which receive the box section telescoping elements 32,34 therein. As will be seen more clearly in later figures, the part of the outer body 44 which forms the vertical part 24 of the boom has an open back 46, and can therefore be considered a U-shaped section. The height H of the body 44 as shown is 498 mm, the width W is 426 mm and the angle A between the boom sections 22,24 is 114°. When combined with the telescoping sections 32,34, this provides a boom length from 600 mm to 900 mm (measured along vertical section 24), plus stepless horizontal adjustment of 100 mm from the end of top section 22. It should be understood that outer bodies having alternative dimensions could be produced if required.

Figure 3:
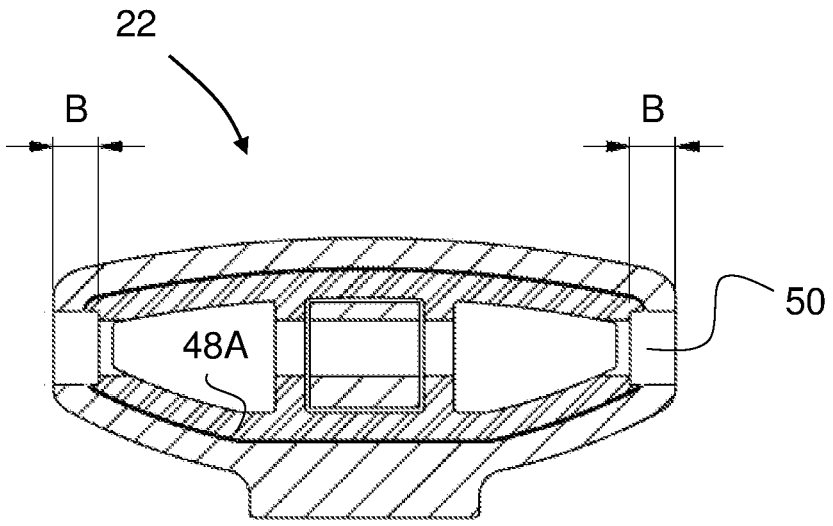
FIG. 3 is a cross-sectional view of a first part of the hoist arm or boom taken at line 3 in FIG. 1.
Figure 4:
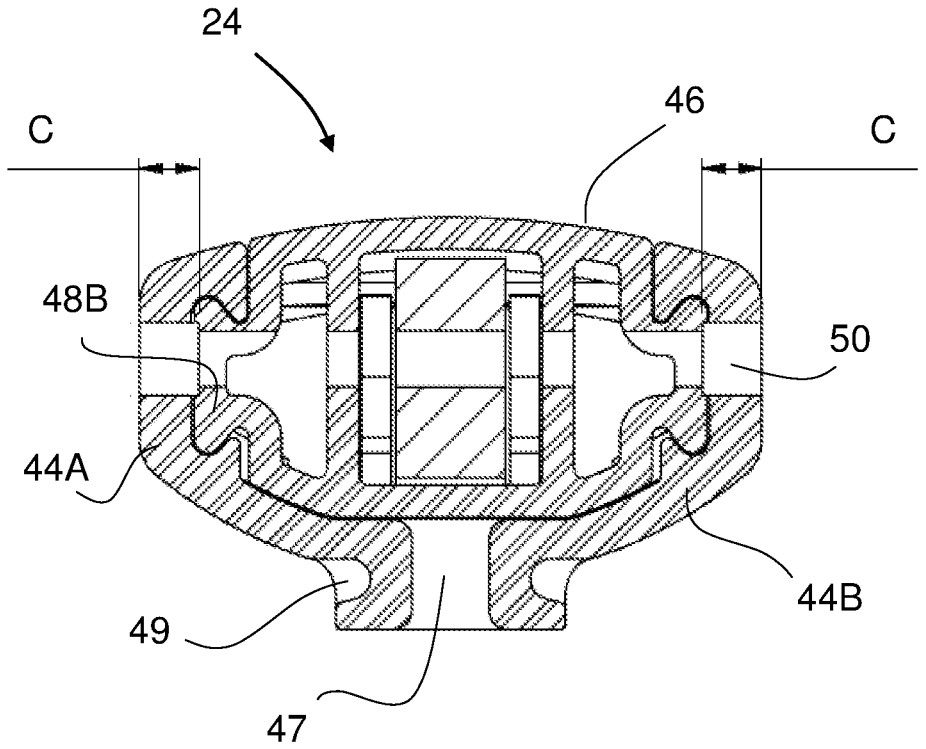
FIG. 4 is a cross-sectional view of a second part of the hoist arm or boom taken at line 4 in FIG. 1.

FIGS. 3 and 4 show cross-section views of, respectively, the top section 22 and vertical section 24 of the boom, taken as indicated at 3 and 4 in FIG. 1. Both cross-sectional views are taken adjacent the join between the vertical section 24 and the top section 22, so both show the outer body 44 with a strengthening element 48 received therein. The strengthening element 48 comprises joined first and second parts 48A,48B, which have cross-sections to fit within the top section 22 and vertical section 24 of the boom respectively, and provides additional strength at a welded joint between these sections.

The open back 46 of the outer body 44 in the vertical section 24 of the boom can also be seen in FIG. 4. The hollow U-shaped cross-section or profile of the outer body 44 in this region is, in fact, formed of two separate extrusions 44A,44B joined together only via the strengthening element 48 at the apex/corner of the boom. A split 47 is therefore provided opposite the open back 46 of the vertical part of the outer body 44. Each extrusion 44A,44B is provided with an elongate channel 49 running along the length of the vertical section 24 on either side of the split 47 in the outer body 44.

Both FIG. 3 and FIG. 4 also show through holes 50, which in this example are 8 mm in diameter, in the sides of the outer body 44 for receiving pins to add strength to the welded joint. Clamping blocks 35 and a cover shown in FIG. 1 are omitted from FIGS. 3 and 4.

The telescoping parts of the top section 22 of the hoist are different from the telescoping parts of the vertical section 24, which allows the boom to better suit the stresses that will be applied. For example, the wall thickness B of the top section shown in FIG. 3 is 5 mm, while the equivalent thickness C in FIG. 4 is 6.5 mm.

It should also be noted the top section 22 shown in FIG. 3 also has a significantly smaller thickness than the vertical section 24 shown in FIG. 4. This helps to reduce the overall height of the hoist mechanism 20, or to increase the carrying space beneath (see FIG. 6).

Figure 5:
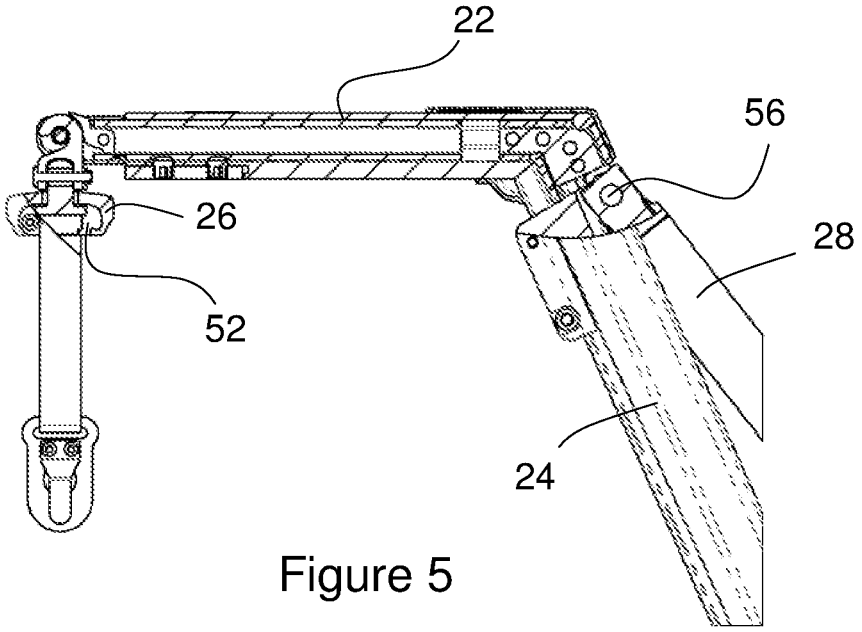
FIG. 5 is a part cross-sectional view of a section of the hoist arm or boom from FIG. 1.

The reduced height of the top section 22 can also be seen in FIG. 5, which shows the top of the vertical section 24 of the boom along with the top section 22 of the boom and the spreader bar 26. The top section 22 is shown in cross-section along its length, and the cross section extends to its join with the vertical section 24. The spreader bar 26 is also shown in a cross-sectional view to illustrate that the spreader bar 26 has an open section 52 at its underside. This further reduces the overall vertical height of the top section 22 providing more space under the hoist mechanism 20 and allowing for a larger scooter to be lifted within the same space.

Figure 6:
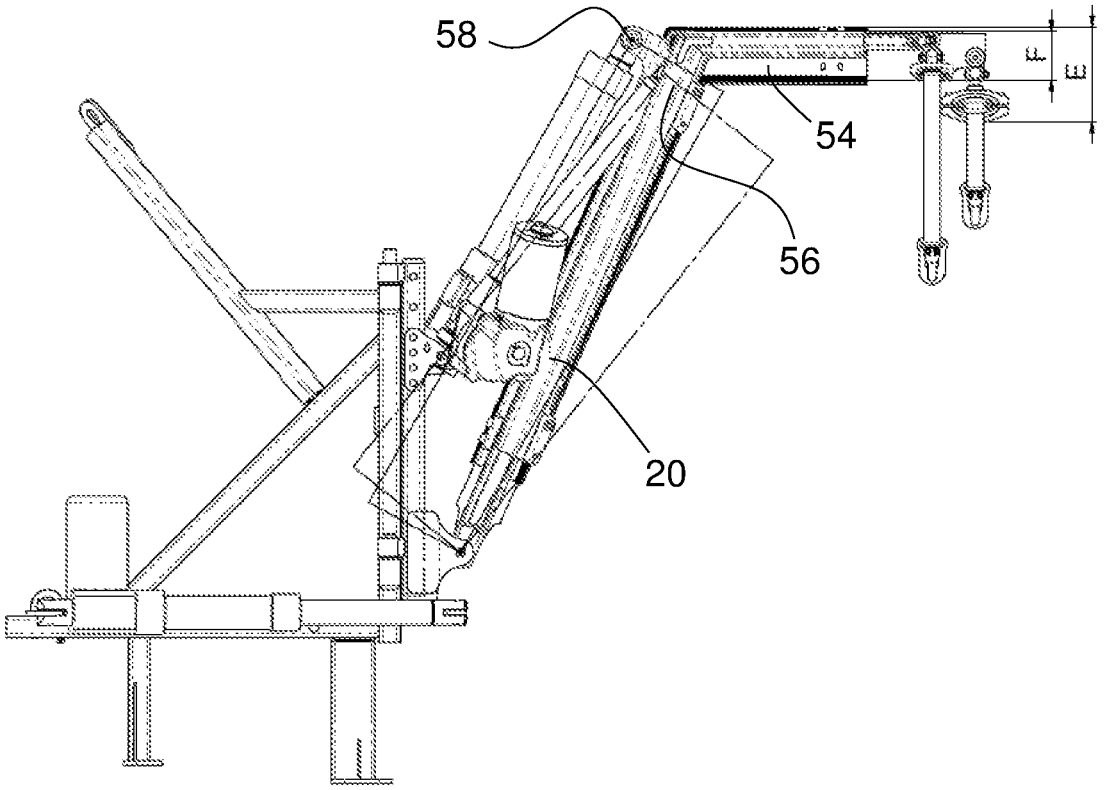
FIG. 6 is a comparative view showing the hoist mechanism of the present invention overlaid with a prior art mechanism.

By way of example, FIG. 6 provides a comparative view of the hoist mechanism 20 of the present invention with a hoist mechanism 54 as described in EP2578197. In the comparison image of the depth E from the top of the hoist described in EP2578197 to the bottom of its spreader bar was 108 mm, whereas in the new design the equivalent depth F it is just 56 mm.

As can also be seen from FIGS. 5 and 6, the end of the actuator 28 is embedded into the arm of the hoist mechanism 20. Specifically, the mounting point 56 for the actuator 28 is provided in the recess 42 provided by the U-shaped profile of the vertical section 24 of the lifting arm. This position of the mounting point 56 within the lifting arm/boom, compared to a mounting point 58 proud of the lifting arm, as in the earlier device 54, improves the actuator 28 mechanical advantage, and allows the actuator 28 to have a shorter overall length for an equivalent stroke. These changes combine to allow the hoist mechanism 20 to be smaller and still give greater lift range while maintaining lift capacity when compared to EP2578197.

For example, the smallest hoist as described in EP2578197 that can be built using a 200 mm stroke actuator is 640 mm and gives a lift range of only 570 mm. With the new design, the smallest hoist can be 600 mm and this has a lift range of 900 mm.

Figure 7:
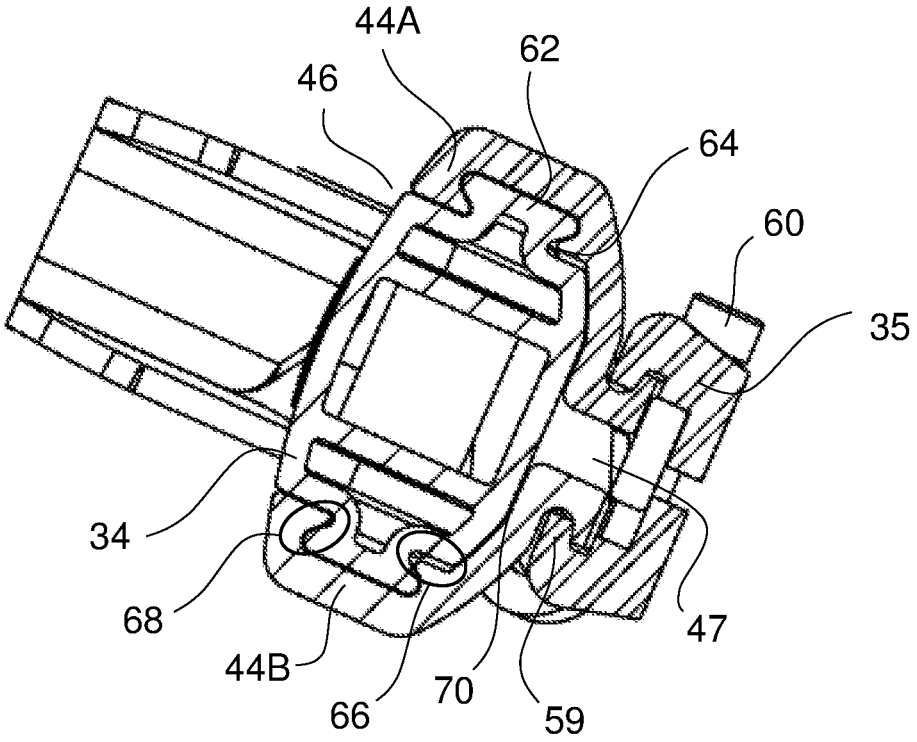
FIG. 7 is a further cross-sectional view of the second part of the hoist arm or boom taken at line 7 in FIG. 1.
Figure 8:
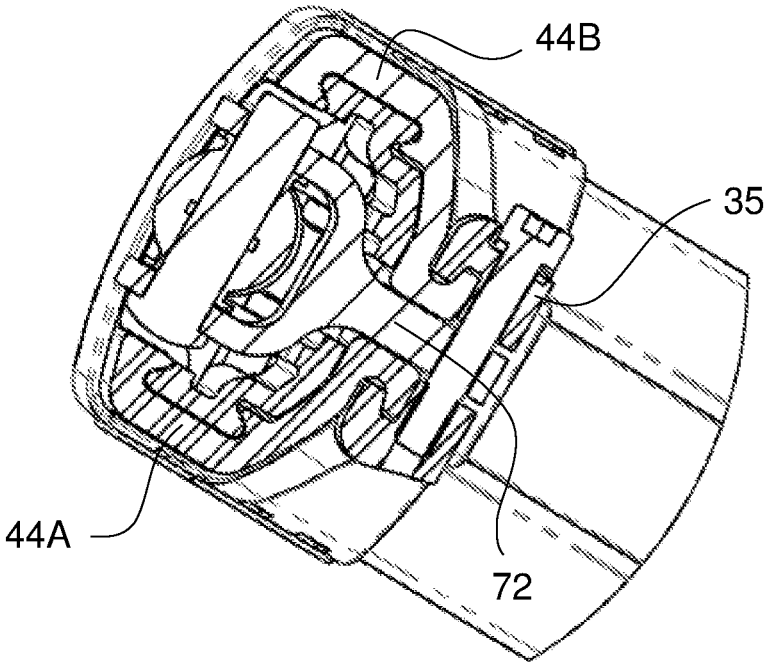
FIG. 8 is a further cross-sectional view of the second part of the hoist arm or boom taken at line 8 in FIG. 1.

FIGS. 7 and 8 show further cross-sectional views of the vertical section 24 of the boom, taken as indicated at 7 and 8 in FIG. 1, to show the interaction between the outer body 44 and the vertical telescoping element 34.

A clamping element 35 is shown in the form of a pair of clamping blocks with protrusions 59 engaging the elongate grooves 49 (see FIG. 4) on the two separate extrusions 44A,44B. A pair of bolts 60 pass through the clamping blocks 35 to allow them to be drawn together, thus closing the split 47 and clamping the outer body 44 to the box section of the vertical telescoping element 34. It will be understood that the clamping blocks 35 can be loosened to allow adjustment of the telescoping element 34 relative to the outer body 44 and then tightened at any desired location to fix the relative positions of the components. The clamping system does not require delimited stops to secure the inner 34 and outer 44 sections at a set position relative to one another, so stepless adjustment of the hoist arm/boom is provided. The elongate grooves 49 and protrusions 59 clamping blocks 35 are designed to be retained when loosened, so that the blocks 35 do not slide off the extrusions 44A,44B unless the bolts 60 are fully removed.

To retain the outer body 44 and telescoping element 34 together when the clamping blocks 35 are loosened, dovetails 62 on the telescoping element 34 engage with corresponding channels in the extrusions 44A, 44B to interlock the parts. Small gaps are provided between the dovetail 62 and the inside of the extrusions 44A,44B at the side nearest the clamping blocks 35, as indicated at 64 in FIG. 7. The small gaps 64 allows some relative rotation of the parts as the bolts 60 are tightened to produce the clamping effect. This rotation allows the extrusions 44A,44B to effectively wrap around the dovetails 62 as the clamping blocks are tightened, applying compression at the interfaces indicated 66 and 68 in FIG. 7. The opposing compressive forces around the dovetails 62 are understood to improve the clamping. The rotation also ensures that compression is made evenly at the interface 70 between the extrusions 44A,44B and the telescoping element 34 opposite the open back 46.

FIG. 8 shows a slightly different clamping arrangement used to clamp the top actuator mounting bracket without applying excessive compression to the outer extrusions 44A,44B where they are not supported by an internal telescoping element 34. The outer sections 44A,44B are pressed against a part of the actuator bracket 72 which extends through the split 47 as the clamping blocks 35 are tightened. The protrusions 59 of the clamping blocks 35 also self lock against the elongate channels 49 of the extrusions 44A,44B. This prevents the arrangement from slipping under tension, while not distorting the outer sections 44A, 44B.

Figure 9:
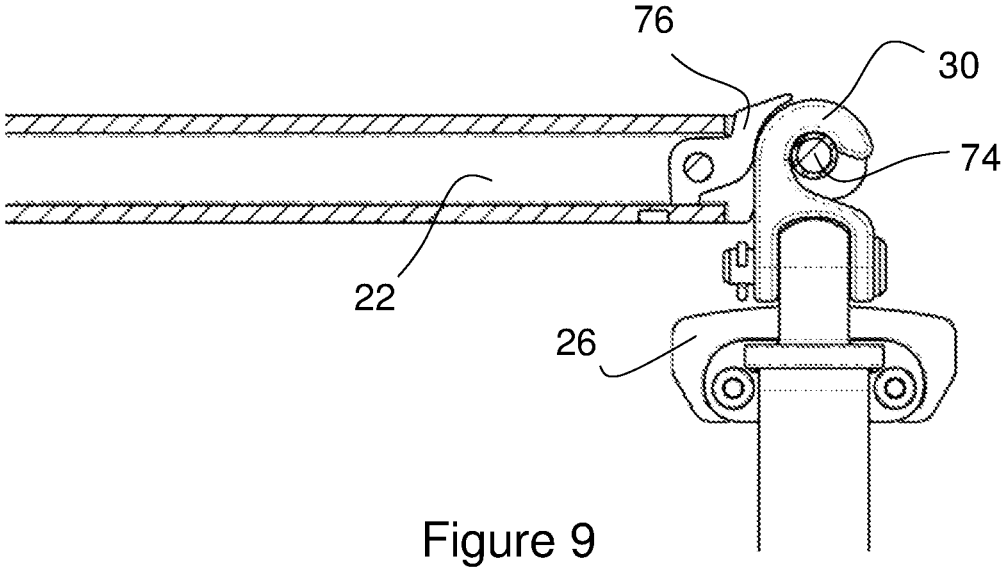
FIG. 9 is a cross sectional view of a hook engaged with the end of a hoist arm according to the invention.

FIG. 9 shows an end of the top section 22 of the boom with the hook 30 of the spreader bar 26 received on a horizontal pin 74. Providing a hook attachment allows the spreader bar 26 to be detached and reattached by the user as required. The spreader bar 26 can thus be stowed when not in use, rather than swinging from the end of the hoist mechanism 20 when a scooter is not attached. It also allows the spreader bar 26 to be swapped between a spreader bar for scooters and one for wheelchairs, or other mobility aids, making the hoist more versatile.

The drawback of providing a hook 30 and pin 74 rather than a permanent connection is the risk of the spreader bar becoming separated from the boom during use of the hoist mechanism.

Providing a hook 30 on the spreader bar 26 rather than on the hoist arm/boom helps to minimise the chance of the hook 30 slipping, and the spreader bar 26 detaching, when the arm is lowered. It should also be noted that the hook 30 is attached with its open section facing outwards, as shown in FIG. 9. It is a feature of the design of the hoist mechanism 20 that the hook 30 can only engage with the pin 74 in this orientation, which is not natural or straightforward without instruction. The reason is that, if the hook 30 were reversed, then it would be able to detach accidentally when the hoist mechanism 20 presses down.

In order to ensure that the hook 30 can only be fitted in the orientation indicated in FIG. 9, a rocker plate 76 is included in the top section 22 of the boom adjacent the horizontal pin 74.

Figure 9A:
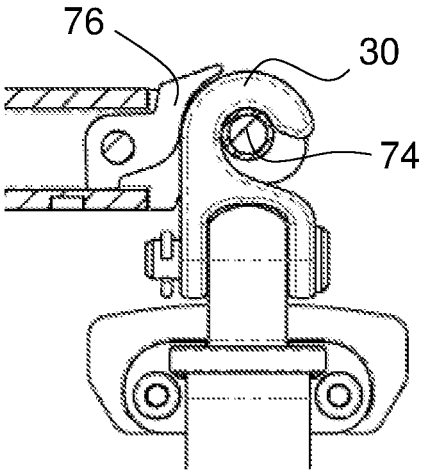
FIGS. 9A to 9C are further views showing the engagement of a hook with the end of a hoist arm according to the invention.
Figure 9B:
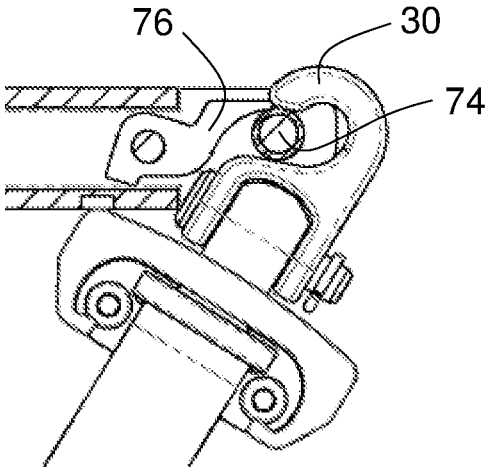
Figure 9C:
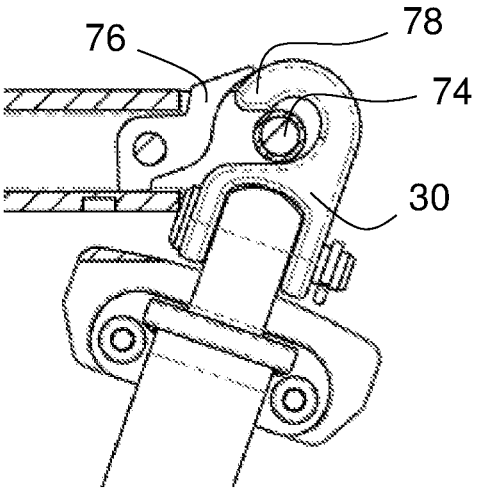

The operation of the rocker plate 76 can be seen more clearly in FIGS. 9A to 9C. FIG. 9 A shows the correct engagement of the hook 30, in the orientation shown in FIG. 9. The rocker plate 76 is lifted as the hook 30 is inserted from below, and rests on top of the closed side of the hook 30 once engaged.

FIG. 9B shows an attempt to engage the hook 30 in the opposite orientation. The rocker plate 76 can be seen in engagement with the pin 74, preventing the pin 74 being received within the hook 30 so that the hook cannot fit.

Even if the rocker plate 76 is lifted to try to fit the hook incorrectly, as illustrated in FIG. 9C, the hook 30 cannot be engaged with the pin 74 in this orientation. The shape of the open end of the hook 30 is wider, at the only angle possible to present the hook 30 to the pin 74, than the space between the rocker plate 76 and the pin 74. The wider or thicker portion 78 of the hook 30 is indicated in FIG. 9C. When the hook 30 is correctly attached from below, the wider portion 78 has space to engage with the pin 74 and can then rotate around the pin and pass through the space between the rocker plate 76 and the pin 74, in order to arrive at the configuration of FIG. 9A.

It should be understood that while developed for, and described in relation to a hoist arm, a number of the features described above, such as the stepless adjustment system, may also find uses in numerous other applications.

The invention claimed is:

1. A hoist mechanism, for loading into or unloading from a load carrying space of a vehicle, comprising a stepless adjustment system comprising an inner section received within an outer section n a telescoping arrangement, wherein the outer section comprises first and second body portions each provided with engagement features which interlock, in use, with corresponding engagement features provided on the inner section, wherein a gap is provided between at least one of the engagement features of the first and second body portions and at least one of the engagement features provided on the inner section to allow rotation of the first and/or second body portions when the first and second body portions are forced together; wherein the hoist mechanism is installable in said vehicle and comprises a lifting arm pivotally connected to an actuator, the inclination of said lifting arm being controlled by the actuator, and wherein the lifting arm is variable in upstanding height by a provision of a lower end section slidably connected to a main body of the lifting arm and comprises the stepless adjustment system; and wherein the lifting arm is connected to the actuator at a mounting point via a pivot, the pivot located within an outer profile of the lifting arm.

2. A hoist mechanism according to claim 1, wherein fixing or clamping means are provided to force the first and second body portions together in use.

3. A hoist mechanism according to claim 2, wherein the fixing or clamping means comprises a pair of clamping blocks.

4. A hoist mechanism according to claim 3, wherein one or more bolts is provided between the clamping blocks for adjusting the spacing of the clamping blocks.

5. A hoist mechanism according to claim 1, wherein each of the engagement features on the inner section comprises a projection and/or recess for receiving a corresponding recess and/or projection of the first or second body, portion.

6. A hoist mechanism according to claim 5, wherein each of the engagement features on the inner section comprises a cross-sectional shape which mates with a corresponding cross-sectional shape of the first or second body portion.

7. A hoist mechanism according to claim 5, wherein the engagement features on the first and second body portions each receive corresponding engagement formations of the inner section.

8. A hoist mechanism according to claim 5, wherein the first and second body portions each engage corresponding engagement features of the first section at first and second engagement points, and apply forces to the corresponding engagement formations at the first and second engagement points.

9. A hoist mechanism according to claim 1, wherein each of the engagement formations of the inner section protrudes outwardly from the inner section.

10. A hoist mechanism according to claim 9, wherein each of the engagement formations of the inner section defines at least one shoulder for engaging a corresponding portion of the first or second body portion.

11. A hoist mechanism according to claim 10, wherein each of the engagement formations of the inner section defines first and second shoulders for engaging corresponding engagement formations of the first or second body portion.

12. A hoist mechanism according to claim 11, wherein each of the engagement formations of the inner section has a dovetail cross-section.

13. A hoist mechanism according to claim 1, wherein the first and second body portions define a hollow enclosure when the first and second body portions are attached to one another.

14. A hoist mechanism according to claim 13, wherein the hollow enclosure comprises an open section on one side and a split line opposite the open section to allow the first and second body portions to be drawn together.

15. A hoist mechanism according to claim 1, wherein the first and second body portions rotate into engagement with the corresponding engagement formations of the inner section as they are drawn together.

16. A hoist mechanism according to claim 15, wherein the first and second body portions rotate about a central longitudinal axis of the inner section.

17. A hoist mechanism according to claim 1, wherein the lower end section comprises the inner section and the main body comprises the outer section.

18. A hoist mechanism for loading into or unloading from load carrying space of a vehicle, the hoist mechanism being installable in said vehicle and comprising a lifting arm pivotable about a generally horizontal axis, and a spreader bar releasably attachable to the lifting arm, the spreader bar comprising a hook formation for engaging a corresponding engagement formation of the lifting arm; wherein a movable blocking component is provided on the lifting arm to obstruct access to the engagement formation and the movable blocking component comprises a rocker plate biased into engagement with the engagement formation.

19. A hoist mechanism for loading into or unloading from a load carrying space of a vehicle, the hoist mechanism being installable in said vehicle and comprising a lifting arm pivotable about a generally horizontal axis and pivotally connected via a pivot at an actuator mounting point to an actuator for controlling the inclination of said lifting arm, wherein the lifting arm has, at least in part, a generally U-shaped cross section, wherein the pivot of the actuator mounting point is provided within the generally U-shaped cross section, and wherein the lifting aim is telescopically adjustable in length, and comprises an inner section received within the U-shaped cross section in a telescoping arrangement.

20. A hoist mechanism according to claim 19, wherein the lifting arm comprises a stepless adjustment system comprising an inner section received within an outer section in a telescoping arrangement, wherein the outer section comprises first and second body portions each provided with engagement features which interlock, in use, with corresponding engagement features provided on the inner section, and wherein a gap is provided between at least one of the engagement features of the first and second body portions and at least one of the engagement features provided on the inner section to allow rotation of the first and/or second body portions when the first and second body portions are forced together.

21. A hoist mechanism according to claim 19, further comprising a spreader bar releasably attachable to the lifting arm, the spreader bar comprising a hook formation for engaging a corresponding engagement formation of the lifting arm.

22. A hoist mechanism according to claim 18, wherein the hook formation is shaped to prevent inadvertent removal of the spreader bar from the lifting arm during use.

23. A hoist mechanism according to claim 18, wherein the maximum thickness of the hook formation on a first side is greater than the maximum space available between the movable blocking component and the engagement formation.

24. A hoist mechanism according to claim 23, wherein the first side of the hook formation is an open side.

25. A hoist mechanism according to claim 18, wherein the engagement formation comprises a horizontal pin.

* * * * *